United States Patent [19]

Hubbard

[11] 4,129,239

[45] Dec. 12, 1978

[54] CLAMPING DEVICES FOR DOCUMENT TRACTORS

[75] Inventor: Leo J. Hubbard, Somerset, Mass.

[73] Assignee: Precision Handling Devices, Inc., Assonet, Mass.

[21] Appl. No.: 823,370

[22] Filed: Aug. 10, 1977

[51] Int. Cl.[2] ..... B65H 17/34

[52] U.S. Cl. ..... 226/75

[58] Field of Search ..... 226/74, 75, 79, 170, 226/179

[56] References Cited

U.S. PATENT DOCUMENTS

| | | | |
|---|---|---|---|
| 3,938,721 | 2/1976 | Staneck | 226/75 |
| 3,941,288 | 3/1976 | Wanat | 226/74 |

*Primary Examiner*—Richard A. Schacher
*Attorney, Agent, or Firm*—Martin Lukacher

[57] ABSTRACT

In order to clamp a document metering tractor to a support shaft which together with a drive shaft provide a mounting for the tractor and without causing interference, such as binding, with the drive imparted by the drive shaft, a device is provided for clamping the tractor to the support shaft. This device consists of two parts one of which contains a split ring through which the support shaft extends and the other is a member for closing the ring and retaining it in closed condition. The split ring part may be a collet located internally of the tractor or a sleeve extending externally of the tractor and having the split ring as a portion thereof. In either case, a floating connection is provided between the split ring part and the tractor such as may be afforded by an enlarged opening in the tractor which contains the split ring part. The closing part is a member rotatable with respect to the split ring and may be provided by another ring having flats which engage the outer walls of the collet when relative rotation occurs. The rotatable part may be a screw which closes jaws extending from the split ring part which is disposed outside of the confines of the tractor. In either case the tractor may be movable axially of the drive and support shafts so as to locate the driving pins thereof with respect to the perforations in the document. When the proper alignment is obtained the clamp engages the tractor with the support shaft and locates it without giving rise to any torques or other forces which might otherwise interfere with the driving of the document.

16 Claims, 9 Drawing Figures

CLAMPING DEVICES FOR DOCUMENT TRACTORS

The present invention relates to mechanisms for feeding, advancing, or positioning movable members such as perforated webs and particularly to such feeding mechanisms which are movable to different operating positions and are clamped for operation at any such positions.

The invention is especially suitable for use in a feeding mechanism known as a tractor which has an endless belt carrying pins which engage perforations especially in edge perforated documents such as used in computer peripheral equipment such as printers, teletypewriters and the like. A tractor of the type wherein the invention may find application is described in U.S. Pat. No. 3,825,162 issued July 23, 1974 to Leo J. Hubbard.

A tractor mechanism is carried on a drive shaft which drives the sprocket which in turn drives the belt carrying the document engaging pins. Another shaft usually parallel to the drive shaft also supports the tractor. Two tractors are usually employed for driving at perforations along each edge of the document. Documents come in varying widths and the spacing of the perforations with respect to the edge of the document may vary. Accordingly, the tractor must be positionable, i.e., movable axially, along the drive and support shafts. When the position in proper alignment with the document perforations is obtained, the tractor must be clamped. The clamp should be releasable so as to reposition the tractor.

Various attempts have been made to provide suitable clamping mechanisms for tractors. Clamping blocks attached to the tractor and fastened to the shafts by clamping bolts have been proposed (see Nystrand, U.S. Pat. No. 3,608,801, issued Sept. 28, 1971). Quick release devices having cam surfaces have also been proposed (see Davies, U.S. Pat. No. 3,283,875, issued Nov. 8, 1966, and Staneck, U.S. Pat. No. 3,688,959, issued Sept. 5, 1972). Such devices have several drawbacks. They tend to apply forces to the shafts which cause interference with the drive for the tractor. The shaft need only be bent slightly in order to cause binding in the drive mechanism. Misalignment of the perforations and the pins carried by the tractor belt may also result from the bending of the shafts. Even a small pressure on the bearings in the tractor or in the drive from the motor (which may be a precision gear drive) can cause interference. The clamps also interfere with the location and adjustment of the tractor in those cases where precise tolerances in the location of the drive and support shafts is not maintained. Tractors must however be usable in a wide number of equipments which may be manufactured to different tolerances. Accordingly, the clamping device can make the tractor unsuitable for use with some equipments thereby limiting the commercial application of the tractors themselves.

It is an object of the present invention to provide an improved feed mechanism for metering of documents which mechanism may be positioned and clamped in position and wherein the foregoing difficulties and disadvantages are avoided.

It is a further object of the present invention to provide an improved document tractor having a clamping mechanism which does not, when engaged, cause interference with the drive for the tractor such as by applying pressure on the bearings in the tractor when the drive for the tractor.

It is a still further object of the present invention to provide a improved document tractor having a clamping mechanism which is applicable to a large number of equipments notwithstanding variations in manufacturing tolerances as might prevent the use of the tractor in such equipments.

It is a still further object of the present invention to provide an improved document tractor having a clamping mechanism which is low in cost having only two parts and which may be readily assembled in the tractor.

Briefly described, a feed mechanism such as a document tractor, which is received by a drive shaft and a support shaft and is axially movable along these shafts so as to position the tractor in alignment with the perforations of the documents to be driven, may be clamped to the support shaft by a clamping mechanism embodying the invention, which mechanism has only two operational parts. One of these parts is a split ring member and may take the form of a collet disposed internally of the tractor around the support shaft, or as a sleeve extending outwardly from the tractor to a split ring portion. The split ring part is received within an opening in the tractor which may be larger than the part so as to provide a floating connection between the split ring part and the tractor. The other part of the clamping mechanism serves to close the split ring and may be either another ring having flats disposed around the collet split ring and rotatable with respect thereto. Or, in the case of the split ring portion which is disposed externally of the tractor, may be a thumb screw mounted to close jaws which extend from the split ring portion thereof. The closing mechanism using the locking ring may be disposed either in clamped or released position, while the thumb screw provides variable tightening of the split ring. In either case only two parts are necessary and attaching hardware, springs or other devices are eliminated. The floating connection enables the clamping mechanism to adjust itself so as to be received on the shaft notwithstanding differences in size or position thereof as may arise due to variations in manufacturing tolerances. The floating connections also avoid the generation of torques or other forces which can exert pressure on the bearings in the tractor or in the drive therefor, thus avoiding interference as may produce hard driving action.

The foregoing and other objects, advantages and features of the invention as well as presently preferred embodiments thereof will become more apparent from a reading of the following description in connection with the accompanying drawings in which.

Figure 1:
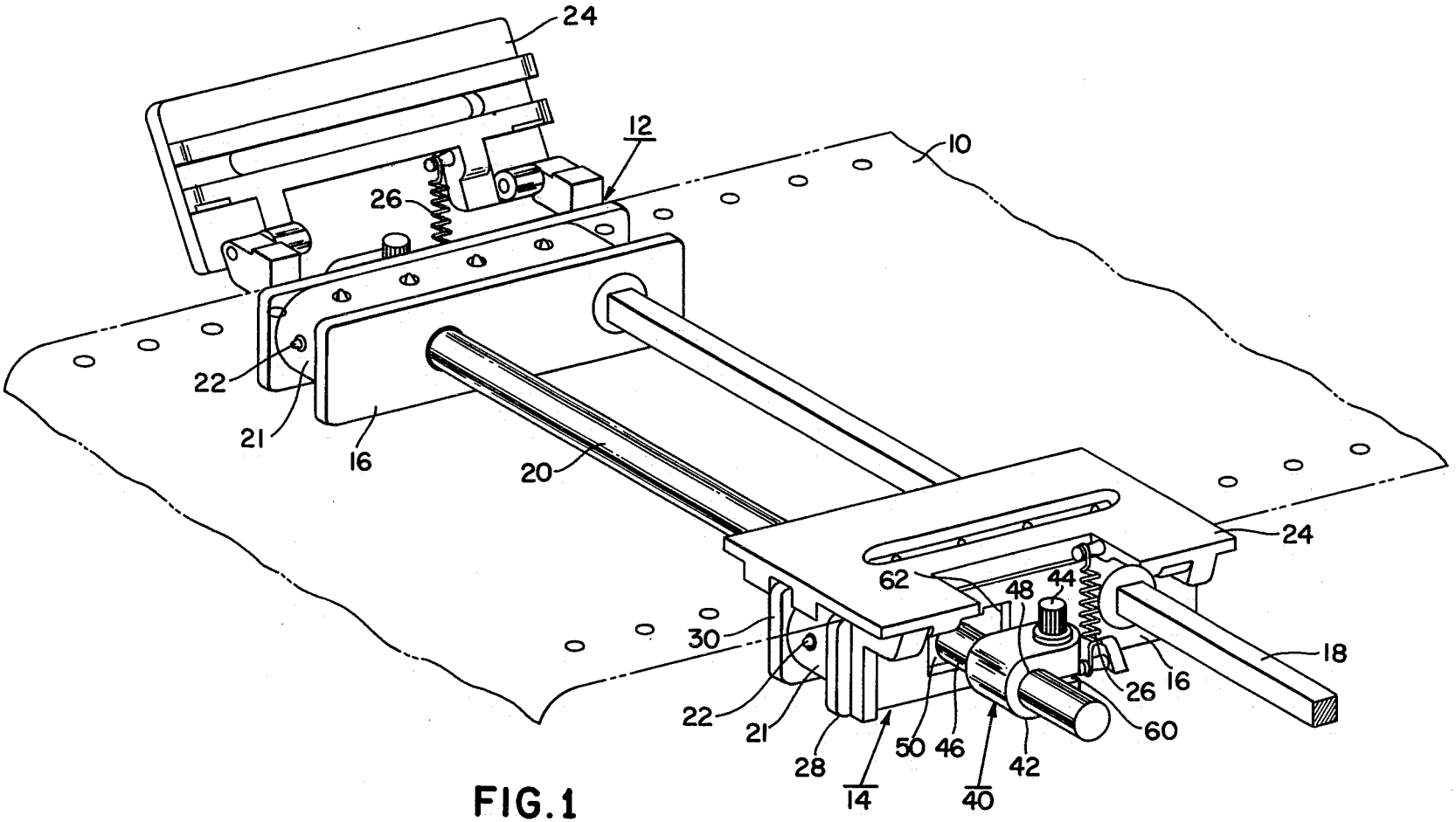
FIG. 1 is a perspective view showing a pair of document tractors embodying the invention in accordance with one embodiment thereof and showing the manner in which the tractors may be adjustably positioned on their drive and support shafts.

Referring to FIG. 1 there is shown a typical installation for feeding or metering a document 10. This document is typical of the edge perforated computer forms used in a printer or other computer peripheral equipment equipped with feed mechanism provided by the invention. Other webs may similarly be driven.

The feed mechanism is provided by a pair of document tractors 12 and 14. These tractors have frames 16 which are mounted on a pair of parallel shafts 18 and 20. The shaft 18 is a drive shaft and is driven by the motor of the equipment with which the tractors 12 and 14 are used. A gear drive or chain drive is usually employed to drive the shaft 18. Any interference with the drive, as may be caused by binding of the shaft, or of the bearings in the tractors 12 and 14, prevents proper driving action and may even cause misalignment of the tractors 12 and 14 which would skew or distort the document 10 as it is driven.

The drive itself is by means of endless belts 21 having drive elements in the form of drive pins 22. The document is held on the belt with the pins 22 extending through the perforations therein by means of apertured guide plates 24 which are hinged to the frames 16 and may be flipped against the bias of springs 26 to open or closed positions.

Since the documents come in different sizes and widths and also because the perforations may have different spacing widthwise of the documents, it is necessary that the tractors 14 and 16 be movable laterally so as to align the drive pins 22 with the perforations in the documents 10. Such lateral movement must be accommodated by the drive and support shafts 18 and 20. The tractors 14 and 16 must not, when adjusted in position, interpose any torques or bending moments on the shaft which would tend to bind the drive. The tractors, when positioned, must be fastened in place so that their frames do not move while the document is being metered. It is a feature of this invention to provide document tractors having clamping mechanisms which can be fabricated at very low cost and assembled readily with the tractor, but which enable the tractors to be positioned on the shaft and then clamped or locked to the shaft without interposing any appreciable torques which would cause the drive to bind or otherwise result in hard driving when the tractor is in document metering operation.

Figure 2:
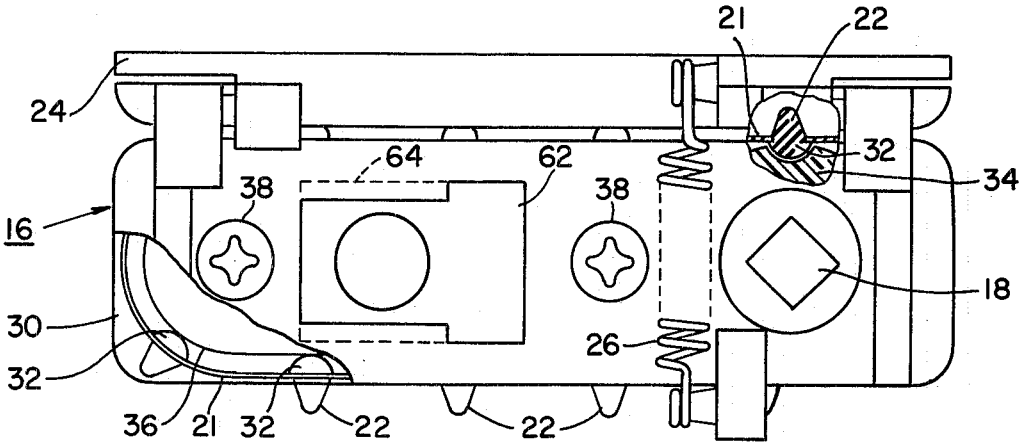
FIG. 2 is a side view of one of the document tractors shown in FIG. 1 with the clamping mechanism thereof removed.
Figure 3:
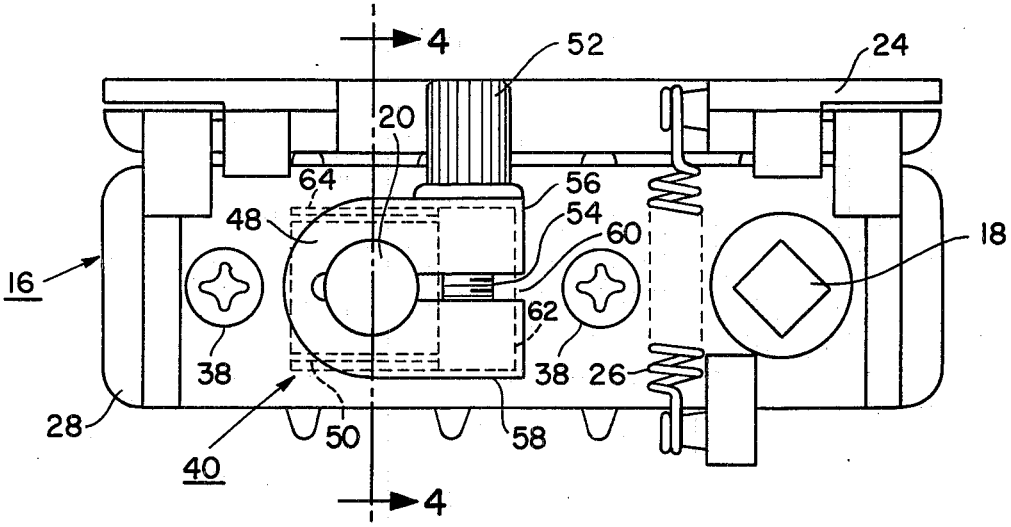
FIG. 3 is a side view similiar to FIG. 2 but with the clamping mechanism assembled and disposed in clamping engagement with the support shaft for the tractor.
Figure 4:
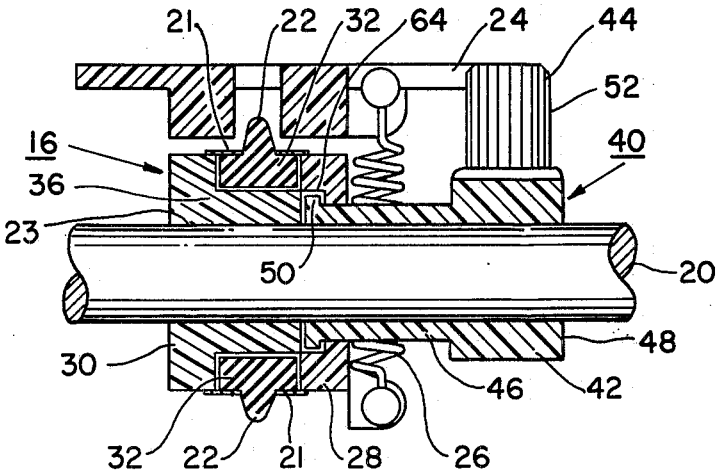
FIG. 4 is a sectional view of the document tractor shown in FIG. 3 and taken along the line 4—4 in FIG. 3.
Figure 5:
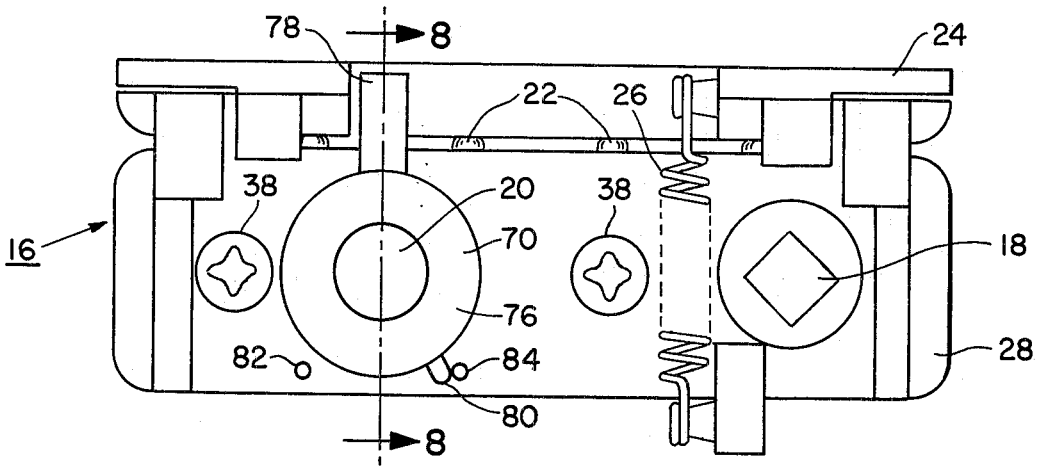
FIG. 5 is a side view of a document tractor in accordance with another embodiment of the invention.
Figure 6:
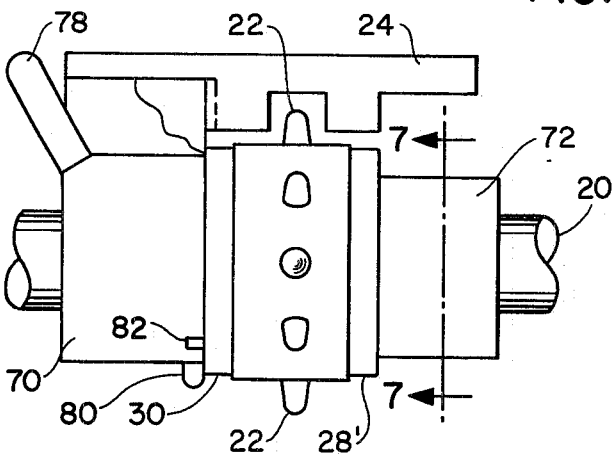
FIG. 6 is an end view of the tractor shown in FIG. 5.

The tractor 14 shown in FIG. 1 and also in FIGS. 2 through 4 embodies a clamping mechanism which satisfies these requirements in accordance with one embodiment of the invention.

Before proceeding with a description of this clamping mechanism it will be observed in FIGS. 1 and 2 that the frame 16 has two parts 28 and 30. These parts define the path for the belt 20. The belt 20 has drive pins 22 and rollers 32. These rollers are engaged by a sprocket 34 which is driven by the drive shaft 18 and in which the rollers 32 are received. One of the frame parts 30 defines a guide 36 around which the rollers 32 travel. Reference may be had to the above-identified patent issued in the name of Leo J. Hubbard for further information respecting the drive and the design and manufacture of the belt 20, the drive pins 22 and the rollers 32.

As shown in FIGS. 3 and 4, the sides 28 and 30 are assembled together by means of screws 38. The clamping mechanism 40 has only two operational parts 42 and 44. The first part 42 is in the form of a sleeve 46 having a split ring portion 48 at the ends thereof which is disposed outwardly from the spring and a foot 50 which is disposed within the frame 16.

The second part 44 is in the form of a thumb screw having a cap 52 and a threaded end 54. The threaded end 54 is received within threaded holes in jaws 56 and 58. These jaws extend laterally from the split ring portion 48 and form part thereof. The jaws are one opposite sides of the split 60. The part 44 may of course be made in two sections, say with a spacer which forms part of the cap 52. It will be appreciated of course but notwithstanding the use of a spacer or the like, the part 44 is nevertheless one operational part; thus only two operational parts, namely the sleeve part 46 and the closing part 44 are the only parts needed for the clamping mechanism.

When the thumb screw 44 is tightened, the jaws, which due to their resiliency are normally biased away from each other, are brought together closing the slit 60 and clamping the split ring to the support shaft 20. The amount of resiliency in the split ring may be controlled by extending the slit 60 downwardly along the sleeve 46. Then both a portion of the sleeve 46 and the split ring 42 will be enclosed by the thumb screw 44. The amount of force applied by the thumb screw is continuously variable, thus providing variable tightening or clamping action. This further prevents the clamping mechanism from giving rise to any torques or other moments which could cause binding or pressure in the system for driving the shaft 18.

The avoidance of such binding and pressure which might give rise to hard driving condition is further prevented by means of a floating connection between the clamping mechanism 40 and the frame 16. As is best shown in FIG. 2 wherein the sleeve 46 and the shaft 20 are removed to facilitate the illustration, there is provided a keyway 62 in the side frame 28. The inside of this keyway is formed with a slot 64 on the inside of the side plate 28. When the side plates 28 and 30 are assembled, the slot 64 provides an opening which is larger than the foot 50 in its dimensions and which recieves the foot 50. The foot 50 may be assembled in the slot while the side plates 28 and 30 are assembled to each other by means of the screws 38 or inserted via the keyway 62.

When the split ring is opened, i.e., the thumb screw 44 is loosened, the tractor 14 and particularly its frame 16 is free to move laterally along the support shaft 20 and the drive shaft 18. The diameter of the support shaft 20 is smaller than the diameter of the opening 23 in the side frames 28 and 30 which receives the support shaft. The square hole which receives the drive shaft 18 is also of dimensions larger than the dimensions of the drive shaft.

The sleeve, prior to the closing of the split ring 48 thereof, has an inside diameter larger than the inside diameter of the support shaft 20. Accordingly, the tractor may be moved easily and will accommodate any misalignment due to manufacturing tolerances which cause variations in the size of the shafts 18 and 20 and their positional relationship. Now, when the thumb screw 44 is tightened and the sleeve and split ring 46 and 48 are securely clamped to the support shaft 20, the floating connection whereby the clamping mechanism is attached to the frame 16 at the foot 50 enables the frame 16 to locate itself in clamped position on the shaft 20 and 22 and without imposing any torque or giving rise to any pressure on the drive system for the drive shaft 18. If, for example, the belt 20 were entrained around an idler sprocket which also afforded the opening 23 for the support shaft 20, severe binding of the belt 20 could result when clamping the tractor to the support shaft 20. This is avoided using the clamping mechanism provided by the invention, and in such case the idler sprocket would be freely rotatable on the support shaft 20.

The tractor may be equipped with clamping mechanism as illustrated in FIGS. 5 through 8. This mechanism also has two parts 70 and 72. The part 70 is in the form of a collet sleeve having clearance for the support shaft 20 so that the tractor may be adjustably positioned on the support shaft 20 and the drive shaft 18. The sleeve is disposed within the opening 23 in the frame 16 which is provided in the side members 28 and 30 thereof. Clearance is provided between the outer periphery of the sleeve 70 and the inner periphery of the opening 23 to provide a floating connection for the sleeve 70 and the clamp mechanism.

The sleeve has four longitudinal slits 74 (see FIGS. 7 and 8) in the portion thereof which extends through the opening 23 for the support shaft 20, and outwardly beyond side member 30. Disposed against the other side member 28 is an enlarged section 76 of the sleeve 70. An arm 78 extends from the rim of this enlarged section 76. A tab 80 also extends from the rim of the enlarged section. A pair of stops 82 and 84 limits the rotation of the sleeve 70 as it is turned as by tilting the arm 78.

The end of the sleeve 74, which passes through the opening 23 and extends past the side member 30, is formed with a lip 86 which extends circumferentially about the sleeve except where broken by the slits 74.

The other of the two parts of the clamping mechanism, namely the part 72, is generally in the shape of a ring which encompasses the end of the sleeve which extends outwardly past the side member 30. The opening 23 is enlarged at the outer wall of the side member 30 and receives the ring 72. Flats 88 (see FIG. 7) restrain the ring 72 against rotation. A step 90 (FIG. 8) in the outer end 92 of the ring 72 engages and holds the lip 86 at the outer end of the sleeve 70; thus limiting axial movement of the parts 70 and 72 without inhibiting rotation of the sleeve part 70. It will be appreciated therefore that only two parts are needed and assembly of the clamping mechanism can readily be accomplished without any additional parts for securing the same on the frame 16.

The ring 72 has its inner wall or periphery formed with flats 94. These flats 94 engage the sleeve 70 so as to close the slits 74. The sleeve is shown in open position in FIG. 7. When turned to closed position the inner periphery of the sleeve 70 engages the clamps the shaft 20. The flats 94 also serve to lock and hold the sleeve in clamped position due to the friction forces acting both on the outer periphery of the sleeve in the ring 72 and between the sleeve and the shaft 20. The clamping mechanism is therefore bistable in operation having two stable positions, either open in the position shown in the drawing, or closed when the sleeve is rotated approximately 45°. When rotated 45° the pad 80 will be positioned against one of the stops 82 or 84. Clearance is provided, not only around the sleeve 70, but also around the ring where the ring is disposed in the side member 30. Accordingly, floating action is provided for and the frame locates itself on the support shaft 20 when the clamping mechanism is operative to clamp the shaft thereby preventing any binding of the drive mechanism as may be caused by pressure due to torques and forces when the clamping mechanism is brought into engagement with the shaft 20. The two parts 70 and 72 thus form a collet which can readily be brought into clamping engagement with the support shaft 20.

Figure 9:
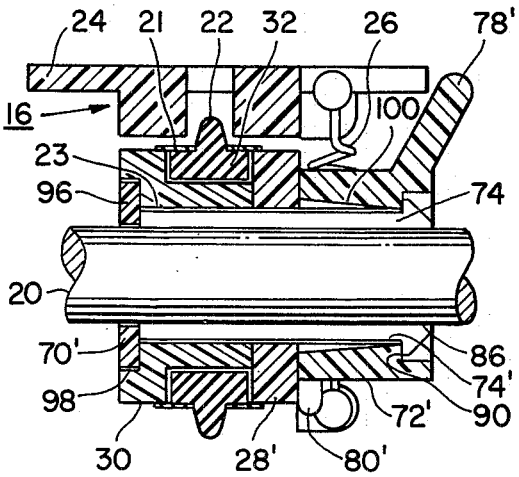
FIG. 9 is a sectional view similar to FIG. 8 but depicting another embodiment of the clamping mechanism for the document tractor.

Referring to FIG. 9, another embodiment of the collet clamping mechanism is shown wherein the sleeve 70' is fixed against rotation and the ring 72' is rotated as by tilting the lever 78'. The sleeve 70' has an end section 96 of larger diameter than the section of the sleeve 70 having the slits 74' therein. This section 96 may be formed with flats which engage flats within the step opening 98, and enlarged section of the opening 23, in which the section 70' is seated. Otherwise the sleeve part 70' is similar to the sleeve part 70 shown in FIGS. 5 through 8. Engagement of the ring part 72 and the sleeve part 80 which assembles these parts on the frame 16 is provided by the lip 86 and the step 90 on these parts as was explained in connection with FIG. 8.

Figure 7:
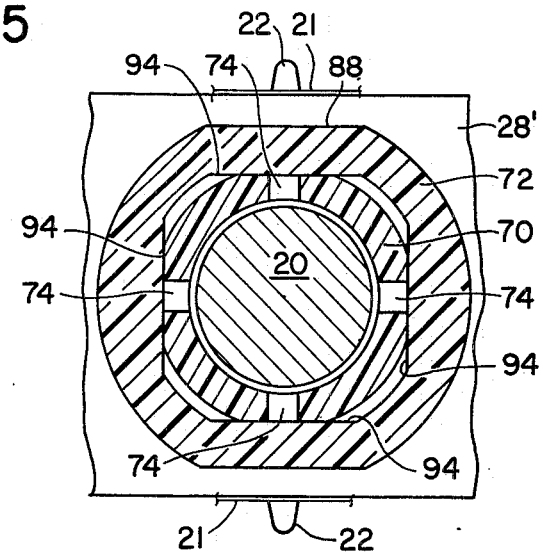
FIG. 7 is a fragmentary sectional view of a portion of the tractor shown in FIGS. 5 and 6, the section being taken along the line 7—7 in FIG. 6.
Figure 8:
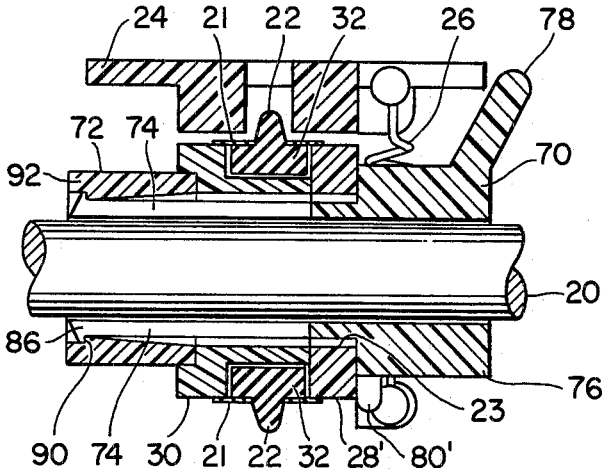
FIG. 8 is a sectional view of the tractor shown in FIGS. 5 and 6, the section being taken along the line 8—8 in FIG. 5.

The ring 72' is rotatable about the end of the sleeve which projects through the outside of side member 28'. The inner periphery 100 of the ring 72' is formed with flats similar to flats 94 (FIG. 7). Accordingly, when the ring 78 is rotated, these flats cam the longitudinal sections of the sleeve inwardly so as to close the slits 74'. The sleeve 70' then clamps the shaft 20. Clearance is provided in the seat 98 and between the opening 23 and the outer periphery of the sleeve 70' so as to provide a floating connection therebetween. The frame then can be clamped to the support shaft 20 without giving rise to any torques or other forces which might cause binding of the drive for the tractor or in the bearings of the sprocket (34, FIG. 2) thereof.

From the foregoing description it will be apparent that there has been provided an improved feed mechanism which provides a document tractor for metering webs such as computer forms and the like. While preferred embodiments of the invention have been described variations and modifications thereof within the scope of the invention will undoubtedly suggest themselves to those skilled in the art. Accordingly the foregoing description should be taken merely as illustrative and not in any limiting sense.

What is claimed is:

1. In a web feeding device having a frame and endless belt carrying drive elements engageable with perforations in the web, said belt being mounted on the frame, a sprocket also mounted in the frame driving in engagement with said belt and around which the belt is driven, said sprocket having an axle for receiving a drive shaft and said frame having an opening for receiving a support shaft which is parallel to said drive shaft, said frame being movable axially of said shafts to adjust the position of said belt to bring said drive elements into registry with the web perforation, a mechanism which enables said frame to be adjustably positioned on said shafts and which clamps said frame in position, said mechanism comprising only a pair of operational parts, a first of said parts having a split ring portion which encompasses said support shaft, means in said frame encompassing the opening which receives said support shaft for receiving said first part and providing a floating connection between said first part and said frame, and a second of said parts being mounted on said first part rotatable within said split ring portion for closing said split ring and bringing said split ring into clamping engagement with said support shaft.

2. The invention as set forth in claim 1 wherein said first part has a sleeve disposed in said support shaft opening, and said means providing said floating connection which includes said support shaft opening having cross-sectional dimensions larger than the cross-sectional dimensions of said sleeve.

3. The invention as set forth in claim 2 wherein said floating connection providing means also includes said support shaft opening having a section of larger cross sectional dimensions at one end thereof at one side of said frame, and means for retaining said first part in said frame being received in said section.

4. The invention as set forth in claim 1 wherein said first part comprises a sleeve having said split ring portion at one end thereof and a foot of larger cross section at the opposite end thereof, said means for providing said floating connection includes a section of said support shaft opening at one side of said frame which defines a keyway having a slot of dimensions larger than said foot, said foot being disposed in said slot and retained therein by said keyway.

5. The invention as set forth in claim 4 wherein said split ring portion has jaws extending therefrom on opposite sides of the split therein, said jaws having threaded holes therein, and a screw threadedly engaged in said holes and extending therebetween across said split for variably tightening said split ring portion to clamp said frame to said support shaft.

6. The invention as set forth in claim 1 wherein said first part has a sleeve which extends through said frame and out of one side thereof, said sleeve having slits to define as said split ring portion a collet which encompasses said support shaft, said second part being a ring disposed around said collet, means for keying one of said ring and said collet against rotation in said support shaft opening, and means for rotating the other of said ring and sleeve for closing said collet around said shaft to clamp said shaft to said frame.

7. The invention as set forth in claim 6 wherein said means providing said floating connection includes said support shaft opening being of diameter larger than the diameter of said sleeve in the portions thereof around said sleeve and of said ring in the position thereof around said ring.

8. The invention as set forth in claim 7 wherein said sleeve has a section of diameter larger than the diameter of said sleeve at one of the opposite ends thereof, said foot being disposed in engagement with said frame to prevent axial movement of said sleeve outward from said support shaft opening in one direction, said sleeve having a lip at the other of the opposite ends thereof said ring having an internal shoulder through which said lip projects and which engages said lip to prevent axial movement of said sleeve outward from said support shaft opening in the axial direction opposite to said one direction.

9. The invention as set forth in claim 6 wherein said sleeve is rotatable in said support shaft opening, said ring is engaged by said keying means, and said rotating means is provided by an extension of said sleeve disposed outward from said support shaft opening which is manually engageable for rotation of said sleeve.

10. The invention as set forth in claim 6 wherein said sleeve is engaged by said keying means, said ring being disposed on one side of said frame, and said rotating means being operative to rotate said ring.

11. In a document tractor having a frame which is supported on a pair of shafts, one of which is a drive shaft and the other of which is a support shaft and is movable laterally across the feed path of the document along said shafts to position said tractor in driving relationship with the document, a mechanism for clamping said frame to said support shaft which comprises an opening in said frame through which said support shaft extends, a keyway into one side of said frame, said keyway being disposed around said opening and defining a slot within said frame entrance to which is through said keyway, a sleeve having a split ring portion on one end thereof and a foot portion on the opposite end thereof, said split ring portion having a pair of jaws on opposite sides of the split therein which extend outwardly, said split ring portion being resilient and biased against closure of said split, the internal diameter of said sleeve including said foot and split ring portions being larger than the diameter of said shaft when said split ring is open, said sleeve being disposed around said shaft with said foot within said slot so as to be mounted in floating relationship in said frame, and means engageable with said jaws for closing said jaws to clamp said frame to said support shaft.

12. The invention as set forth in claim 11 wherein said means engageable with said jaws is provided by a thumb screw, and threaded holes through said jaws having their axes perpendicular to the axis of said shaft.

13. In a document tractor having a frame which is supported on a pair of shafts, one of which is a drive shaft and the other of which is a support shaft, and is movable laterally across the feed path of the document along said shafts to position said tractor in driving relationship with the document, a mechanism for clamping said frame to said support shaft which comprises, a sleeve having an inside diameter normally larger than said support shaft and an outside diameter smaller than the inside diameter of the opening in said frame which receives said support shaft, said sleeve having a slit therein in a portion thereof extending from one end thereof to a section at the opposite end thereof, said slit portion being disposed in said support shaft receiving opening in said frame and extending outwardly through one side of said frame, a ring disposed on the opposite side of said frame around said slit portion, said ring having a wall along its inner periphery with a part of said wall having a diameter less than the diameter of said slit portion, and means for rotating one of said sleeves and said ring for closing said slit portion to clamp said frame to said support shaft.

14. The invention as set forth in claim 13 wherein the said ring has opposite ends one of which is disposed in engagement with said one side of said frame, said inner periphery of said ring having a step therein spaced from said one end thereof, said section of said sleeve being in engagement with said frame at the side thereof opposite said one side, said sleeve having a lip of diameter larger than the inner periphery of said ring which is disposed in engagement with said step for retaining said sleeve within said support shaft opening in said frame.

15. The invention as set forth in claim 14 wherein said means for rotating one of said sleeve and said ring is operative to rotate said ring, and said section of said sleeve is keyed against rotation in said frame.

16. The invention as set forth in claim 14 wherein said means for rotating said one of said sleeve and said ring is operative to rotate said sleeve, and said ring is keyed against rotation in said frame.

* * * * *